US011608970B2

(12) United States Patent
Jiang et al.

(10) Patent No.: US 11,608,970 B2
(45) Date of Patent: Mar. 21, 2023

(54) CLAMPING STRUCTURE AND A TACTICAL LIGHT

(71) Applicant: Shenzhen Olight E-Commerce Technology Co., Ltd., Guangdong (CN)

(72) Inventors: Zhengjun Jiang, Hunan (CN); Shuze Wu, Guangdong (CN)

( * ) Notice: Subject to any disclaimer, the term of this patent is extended or adjusted under 35 U.S.C. 154(b) by 0 days.

(21) Appl. No.: 17/852,398

(22) Filed: Jun. 29, 2022

(65) Prior Publication Data

US 2022/0349558 A1 Nov. 3, 2022

(30) Foreign Application Priority Data

May 18, 2022 (CN) ..... 202221187392.3

(51) Int. Cl.
*F21V 21/088* (2006.01)
*F41G 11/00* (2006.01)
*F41G 1/35* (2006.01)

(52) U.S. Cl.
CPC ..... *F21V 21/088* (2013.01); *F41G 1/35* (2013.01); *F41G 11/003* (2013.01)

(58) Field of Classification Search
CPC . F21V 21/088; F21V 33/008; F21W 2131/40; F41G 1/35; F41G 11/003; F41G 1/32; F41G 1/34
See application file for complete search history.

(56) References Cited

U.S. PATENT DOCUMENTS

| | | | | |
|---|---|---|---|---|
| 10,365,069 | B1 * | 7/2019 | Tayon | F41G 11/003 |
| 2021/0071990 | A1 * | 3/2021 | Galli | F41G 1/35 |
| 2022/0003393 | A1 * | 1/2022 | Starr | F21V 23/04 |
| 2022/0205759 | A1 * | 6/2022 | Huang | F41G 1/35 |

* cited by examiner

*Primary Examiner* — Peggy A Neils
(74) *Attorney, Agent, or Firm* — Prakash Nama; Global IP Services, PLLC

(57) ABSTRACT

A clamping structure and a tactical light, wherein a sliding groove is provided on a bottom part of a clamping space; a plurality of first positioning areas are provided inside the sliding groove along its length direction; a sliding block is slidably provided inside the sliding groove; a plurality of first positioning portions are provided on a side of the sliding block facing the first positioning areas; an abutting component is fixed on the sliding block; when the sliding block slides inside the sliding groove, the abutting component slides along with the sliding block inside the clamping space to adjust the position of the sliding block relative to the clamping device, also, each first positioning portion moves from one first positioning area to another one, thereby fixing the sidling block inside the sliding groove, and realizing adjustment of the position of the clamping device relative to the sliding block.

10 Claims, 4 Drawing Sheets

CLAMPING STRUCTURE AND A TACTICAL LIGHT

BACKGROUND OF THE INVENTION

The present utility model relates to the field of tactical lights, and more particularly a clamping structure and a tactical light.

Currently, a tactical light is configured on a firearm for lighting or launching a line-of-sight. Switches for adjusting lighting and the line-of-sight are provided on the tactical light. As different tactical lights are adopted for different weapons, it is time-consuming to find a tactical light suitable for a specific weapon; as multiple types of tactical lights are needed when carrying multiple weapons, conventional tactical lights have low adaptability due to the inability or difficulty to adjust the clamping devices of the tactical lights with respect to the rails of the firearms.

BRIEF SUMMARY OF THE INVENTION

It is an object of the present utility model to overcome the above drawbacks of the prior art by providing a clamping structure and a tactical light.

To attain the above object, the present utility model provides the following technical solutions:

A clamping structure, comprising:

a clamping device; a clamping space is provided on the clamping device; a sliding groove is provided at a bottom part of the clamping space along a lengthwise direction of the clamping space; a plurality of first positioning areas are provided inside the sliding groove along a lengthwise direction of the sliding groove;

a sliding block; the sliding block is slidably provided inside the sliding groove; at least one first positioning portion extends from a bottom side of the sliding block towards the first positioning areas; the at least one first positioning portion is configured to be positioned corresponding to different first positioning areas as the sliding block slides, and the at least one first positioning portion has a shape capable of fitting with the first positioning areas; when the sliding block slides inside the sliding groove, the at least one positioning portion is capable of being fitted with different first positioning areas at different positions to fix the sliding block inside the sliding groove;

an abutting component; the abutting component is fixedly provided on an upper side of the sliding block and located inside the clamping space; when the sliding block slides inside the sliding groove, the abutting component slides along with the sliding block inside the clamping space, so as to adjust a position of the sliding block with respect to the clamping device.

In one embodiment, the clamping device comprises:

a base; the clamping space is provided on the base;

a fixed clamping block; the fixed clamping block is provided on one side of the base;

a movable clamping block; the movable clamping block is provided on another side of the base; the movable clamping block is movable towards or away from the fixed clamping block under external force; said one side and another side of the base are opposite to each other.

In one embodiment, a plurality of second positioning areas are provided on a side wall of the sliding block facing the movable clamping block; a second positioning portion is provided on a side wall of the movable clamping block facing the sliding block; the second positioning portion is configured to pass through a side wall of the clamping space and insert into one of the second positioning areas when the movable clamping block moves towards the fixed clamping block; when the movable clamping block moves away from the fixed clamping block allowing the sliding block to slide, the second positioning portion is configured to be positioned corresponding to different second positioning areas as the sliding block slides, and the second positioning portion has a shape capable of fitting with the second positioning areas, when the at least one first positioning portion moves to different first positioning areas at different positions, simultaneously, the second positioning portion corresponds to different second positioning areas at different positions.

In one embodiment, the clamping structure further comprises: a locking device, the locking device is configured on the clamping device to lock or unlock the movable block.

In one embodiment, the locking device comprises:

an adjusting screw; a tail part of the adjusting screw first passes through the fixed clamping block and the sliding block, and then inserts into a connecting hole of the movable clamping block;

a clamping component; the clamping component fixedly sleeves onto the adjusting screw to provide clamping force;

a positioning screw nut; the positioning screw nut is inserted into the connecting hole and fixedly connected to a connecting portion of the adjusting screw, so as to prevent the adjusting screw from being disengaged from the clamping device.

In one embodiment, a twisting portion is provided on a head part of the adjusting screw; the twisting portion is configured to accommodate a screwdriver.

In one embodiment, a pair of convex portions is also provided on a head part of the adjusting screw.

In one embodiment, each first positioning portion is an arc-shaped convex element, and each first positioning area is an arc-shaped concave element.

In one embodiment, the second positioning portion is a positioning column, and each second positioning area is a positioning hole.

The present utility model further provides a tactical light comprising the aforesaid clamping structure, and also comprising a light body; the clamping structure is fixedly connected to the light body.

The beneficial effects of the present utility model include:

The sliding groove is provided on the bottom part of the clamping space; the plurality of first positioning areas are provided inside the sliding groove along its lengthwise direction; the sliding block is slidably provided inside the sliding groove; the at least one first positioning portion extends from the bottom side of the sliding block towards the first positioning areas, and the abutting component is fixedly provided on the upper side of the sliding block; accordingly, when the sliding block is sliding inside the sliding groove, the abutting component slides along with the sliding block inside the clamping space, so as to adjust the relative position of the adjusting block and the clamping device; therefore, the at least one positioning portion is capable of being fitted into different first positioning areas at different positions to fix the sliding block inside the sliding groove, thereby realizing the adjustment of the relative position between the clamping device and the sliding block, and thus further realizing the adjustment of the relative position between the tactical light fixedly connected with the clamping device and the rail of the firearm, so as to enhance the adaptability of the tactical light during usage.

Figure 1:
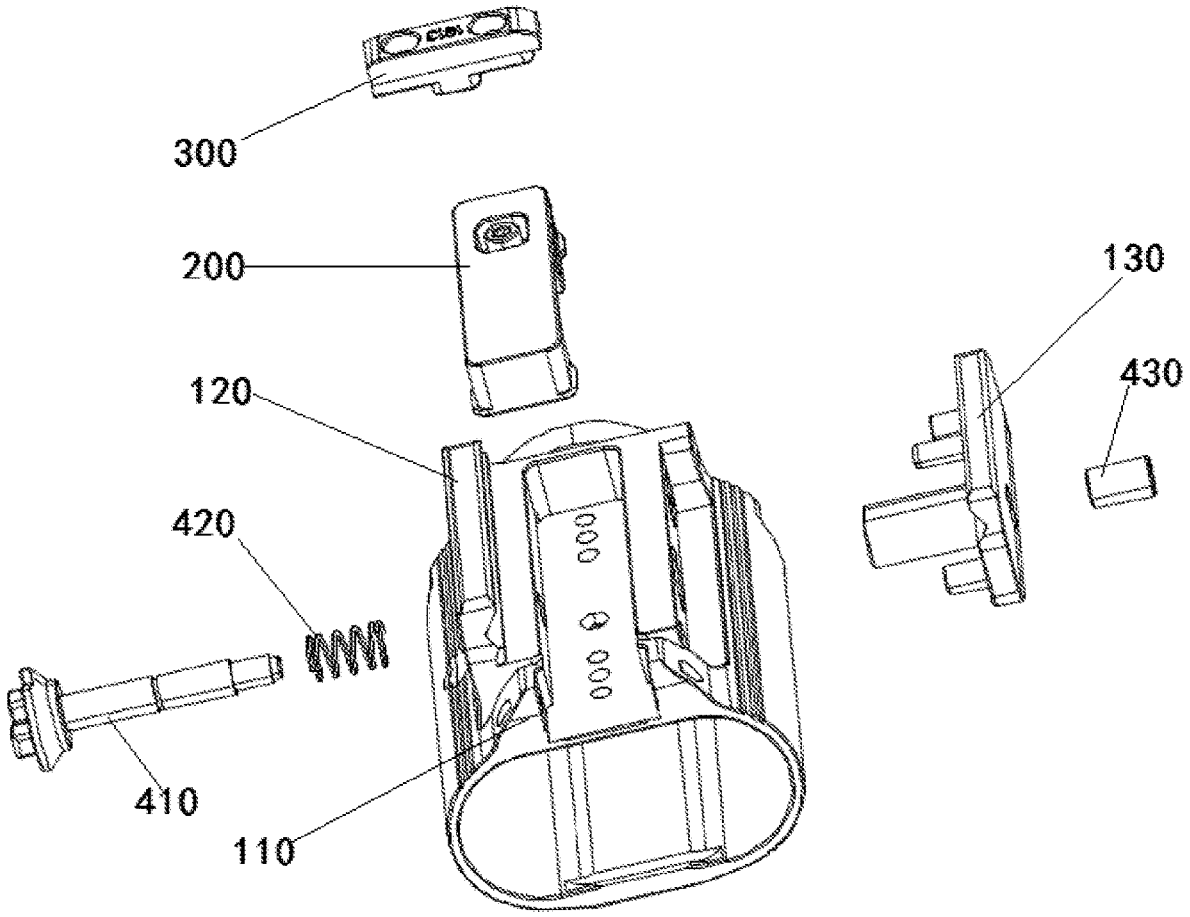
FIG. 1 shows an exploded perspective view of the present utility model.

As illustrated in the figures, 100 denotes the clamping device; 110 denotes the base; 120 denotes the fixed clamping block; 130 denotes the movable clamping block; 131 denotes the second positioning portion; 132 denotes the connecting hole; 140 denotes the clamping space; 141 denotes the sliding groove; 1411 denotes the first positioning areas; 200 denotes the sliding block; 210 denotes the first positioning portions; 220 denotes the second positioning areas; 230 denotes the elongated through hole; 300 denotes the abutting component; 400 denotes the locking device; 410 denotes the adjusting screw; 411 denotes the twisting portion; 412 denotes the convex portions; 413 denotes the connecting portion; 420 denotes the clamping component; 430 denotes the positioning screw nut; 500 denotes the light body.

DETAILED DESCRIPTION OF THE INVENTION

The following describes in detail the embodiments of the present utility model; examples of the embodiments are shown in the accompanying drawings, in which the same or similar reference numerals always indicate the same or similar elements or elements with the same or similar functions. The embodiments described below with reference to the drawings are exemplary, which are only intended to explain the present utility model, but not to set a limit to the present utility model.

In the description of the present utility model, it should be understood that the terms like "length", "width", "upper", "lower", "front", "rear", "left", "right", "vertical", "horizontal", "top", "bottom", "inner" and "outer" indicate the orientation or positional relationship based on the orientation or positional relationship shown in the drawings, which are only for the convenience of describing the present utility model and simplifying the description, instead of indicating or implying that the device or element referred to must have a specific orientation, be constructed and operated in a specific orientation, and thus should not be understood as a limit to the present utility model.

Besides, the terms "first" and "second" are only adopted for descriptive purposes, and cannot be understood as indicating or implying relative importance or implicitly indicating the number of technical features indicated. Therefore, the features defined with "first" and "second" may explicitly or implicitly include one or more of these features. In the description of the present utility model, the meaning of "multiple" refers to two or more than two, unless otherwise specifically defined.

In the description of the present utility model, unless otherwise specified and restricted, the terms such as "mounted", "connected", "attached", "fixed" should be understood in a broad sense; for examples, the terms can refer to a fixed connection, a detachable connection, or connection as an integral component; they can refer to a mechanical connection or an electrical connection; they can refer to being directly connected, being indirectly connected through an intermediate medium, the internal communication between two components, or the interaction between two elements. For those of ordinary skill in the art, the specific meanings of the aforementioned terms in the present utility model can be understood according to specific circumstances.

Currently, a tactical light is configured on a firearm for lighting or launching a line-of-sight. Switches for adjusting lighting and the line-of-sight are provided on the tactical light. As different tactical lights are adopted for different weapons, it is time-consuming to find a tactical light suitable for a specific weapon; as multiple types of tactical lights are needed when carrying multiple weapons, conventional tactical lights have low adaptability due to the inability or difficulty to adjust the clamping devices of the tactical lights with respect to the rails of the firearms.

Figure 2:
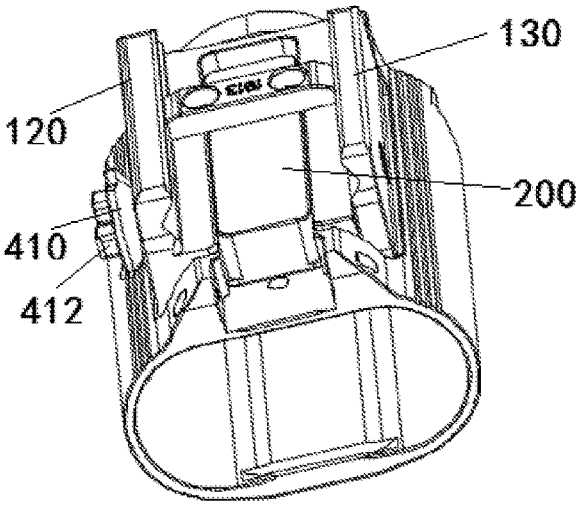
FIG. 2 shows a perspective view of the present utility model.

As illustrated in FIGS. 1-2, firstly, the present application provides a clamping structure comprising a clamping device 100, a sliding block 200 and an abutting component 300; a clamping space 140 is provided on the clamping device 100; a sliding groove 141 is provided at a bottom part of the clamping space 140 along its lengthwise direction; a plurality of first positioning areas 1411 are provided inside the sliding groove 141 along its lengthwise direction; specifically, a plurality of first positioning areas 1411 are provided on a bottom wall of the sliding groove 141; the sliding block 200 is slidably provided inside the sliding groove 141; at least one first positioning portion 210 extends from a bottom side of the sliding block 200 towards the first positioning areas 1411; the at least one first positioning portion 210 is configured to be positioned corresponding to different first positioning areas 1411 as the sliding block 200 slides, and the at least one first positioning portion 210 has a shape capable of fitting with the first positioning areas 1411; specifically, when the sliding block 200 is sliding inside the sliding groove 141, the at least one positioning portion 210 is capable of being fitted into different first positioning areas 1411 at different positions to fix the sliding block 200 inside the sliding groove 141; the abutting component 300 is fixedly provided on an upper side of the sliding block 200 and located inside the clamping space 140; when the sliding block 200 is sliding inside the sliding groove 141, the abutting component 300 slides along with the sliding block 200 inside the clamping space 140, so as to adjust the relative position between the sliding block 200 and the clamping device 100.

As said, the sliding groove 141 is provided on the bottom part of the clamping space 140; the plurality of first positioning areas 1411 are provided inside the sliding groove 141 along its lengthwise direction; the sliding block 200 is slidably provided inside the sliding groove, the at least one first positioning portion 210 extends from the bottom side of the sliding block 200 towards the first positioning areas 1411, and the abutting component 300 is fixedly provided on the upper side of the sliding block 200; accordingly, when the sliding block 200 is sliding inside the sliding groove 141, the abutting component 300 slides along with the sliding block 200 inside the clamping space 140, so as to adjust the relative position of the adjusting block 200 and the clamping device 100; therefore, the at least one positioning portion 210 is capable of being fitted into different first positioning areas 1411 at different positions to fix the sliding block 200 inside the sliding groove 141, thereby realizing the adjustment of the relative position between the clamping device 100 and the sliding block 200, and thus further realizing the adjustment of the relative position between the tactical light fixedly connected with the clamping device 100 and the rail of the firearm, so as to enhance the adaptability of the tactical light during usage.

Figure 3:
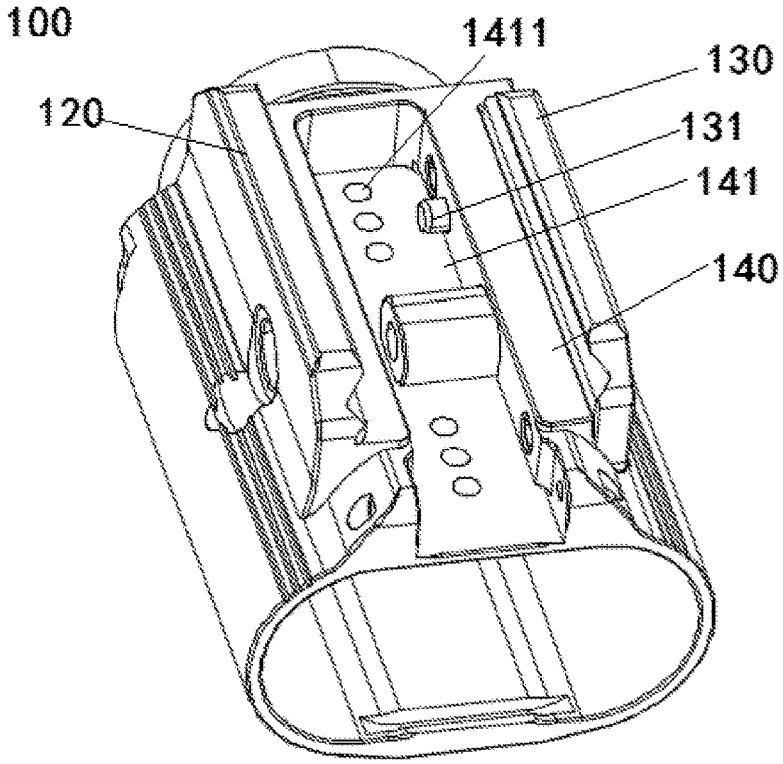
FIG. 3 shows a perspective view of the clamping device of the present utility model.

As illustrated in FIG. 3 according to one of the embodiments, since the clamping device 100 needs to be fixedly clamped on a rail of the firearm during use, the clamping device 100 comprises a base 110, a fixed clamping block 120 and a movable clamping block 130; the clamping space 140 is provided on the base 110; the fixed clamping block 120 is provided on one side of the base 110, and the movable clamping block 130 is provided on another side of the base 110; the movable clamping block 130 can be moved towards or away from the fixed clamping block 120 under external force; said one side and another side of the base 110 are opposite to each other; the movable clamping block 130 is provided to be cooperative with a locking device 400 which will be described below to realize locking or unlocking of the clamping device 100, and is thus convenient for users to adjust the relative position between the sliding block 200 and the clamping device 100; details of the above function will be explained below when describing the mechanism of the locking device 400.

Figure 4:
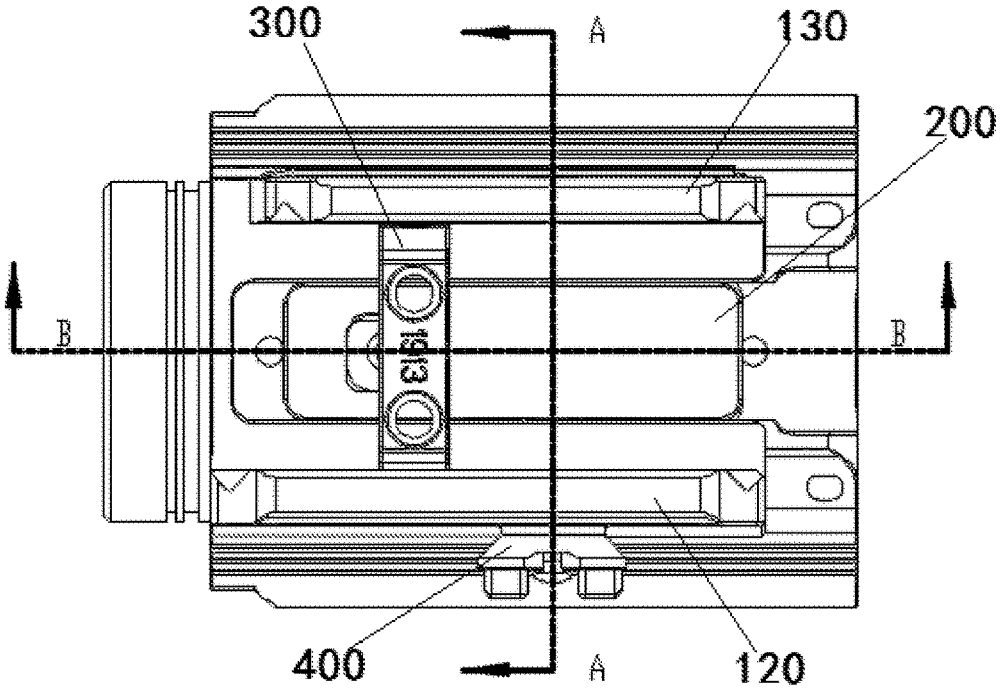
FIG. 4 shows a top perspective view of the present utility model.
Figure 6:
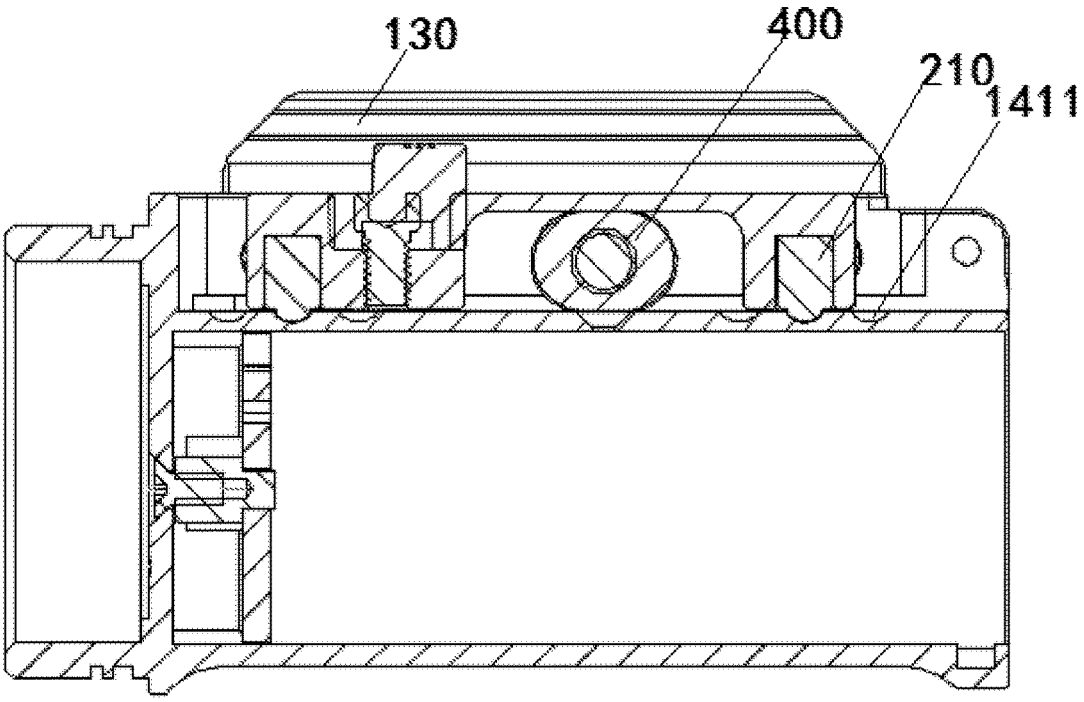
FIG. 6 shows a sectional view of the present utility model along line B-B of FIG. 4.

In one of the embodiments, as illustrated in FIG. 4 and FIG. 6, the first positioning areas 1411 are divided into two sets, wherein each set is provided with three first positioning areas 1411; a first set of the first positioning areas 1411 is arranged near an end of the sliding groove 141 along its lengthwise direction, and a second set of the first positioning areas 1411 is arranged near another end of the sliding groove 141 along its lengthwise direction; correspondingly, two first positioning portions 210 are provided; one of said two first positioning portions 210 corresponds to the first set of the first positioning areas 1411; another one of said two first positioning portions 210 corresponds to the second set of the first positioning areas 1411; by dividing the first positioning areas 1411 into two sets, two ends of the sliding block 200 along its lengthwise direction can be stably positioned inside the sliding groove 141 simultaneously; furthermore, each first positioning portion 210 is an arc-shaped convex element, and each first positioning area 1411 is an arc-shaped concave element; by using the cooperative relationship between convex and concave elements, the first positioning portions 210 can easily slide out of the first positioning areas 1411 when the sliding block 200 slides, so as to be more convenient for users to adjust the position of the tactical light.

Figure 7:
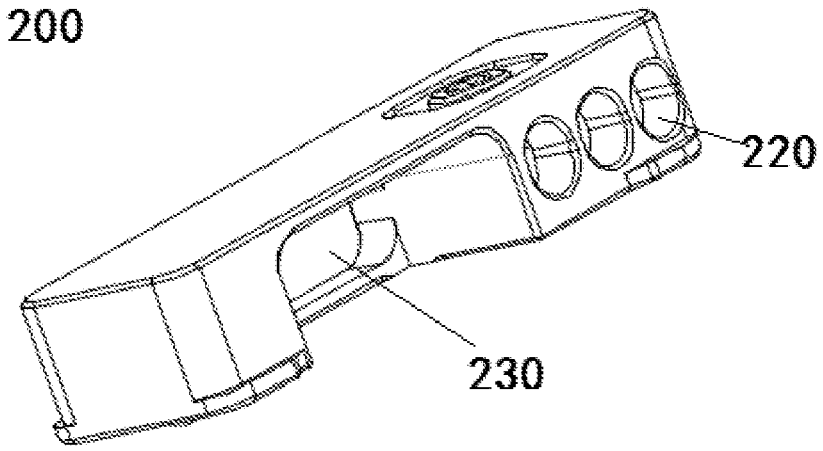
FIG. 7 shows a perspective view of the sliding block of the present utility model.

In one of the embodiments, as illustrated in FIG. 3 and FIG. 7, although the cooperative relationship between convex and concave elements facilitates users to adjust the relative position between the sliding block 200 and the clamping device 100 conveniently, as the clamping device of the present utility model is configured on a firearm, a great impact force will be produced along a lengthwise direction of the sliding groove 141 when the firearm is fired, which would cause the first positioning portions 210 to disengage from the first positioning areas 1411, and thus causing the tactical light to be loosened; therefore, a plurality of second positioning areas 220 are provided on a side wall of the sliding block 200 facing the movable clamping block 130; a second positioning portion 131 is provided on a side wall of the movable clamping block 130 facing the sliding block 200; the second positioning portion 131 passes through a side wall of the clamping space 140 and inserts into one of the second positioning areas 220 when the movable clamping block 130 moves towards the fixed clamping block 120; when the movable clamping block 130 moves away from the fixed clamping block 120 allowing the sliding block 200 to slide, the second positioning portion 131 is configured to be positioned correspondingly to different second positioning areas 220 as the sliding block 200 slides, and the second positioning portion 131 has a shape capable of fitting with the second positioning areas 220; specifically, when the at least one first positioning portion 210 moves to different first positioning areas 1411 at different positions, simultaneously, the second positioning portion 131 corresponds to different second positioning areas 220 at different positions; in the present embodiment, three second positioning areas 220 are provided, which are arranged in sequence along a lengthwise direction of the sliding block 200; one second positioning portion 131 is provided; when the sliding block 200 is sliding, as the second positioning portion 131 inserts into one of said three second positioning areas 220, the at least one first positioning portion 210 is simultaneously inserted into one of the first positioning areas 1411; the second positioning portion 131 is a positioning column, and each second positioning area 220 is a positioning hole.

Figure 5:
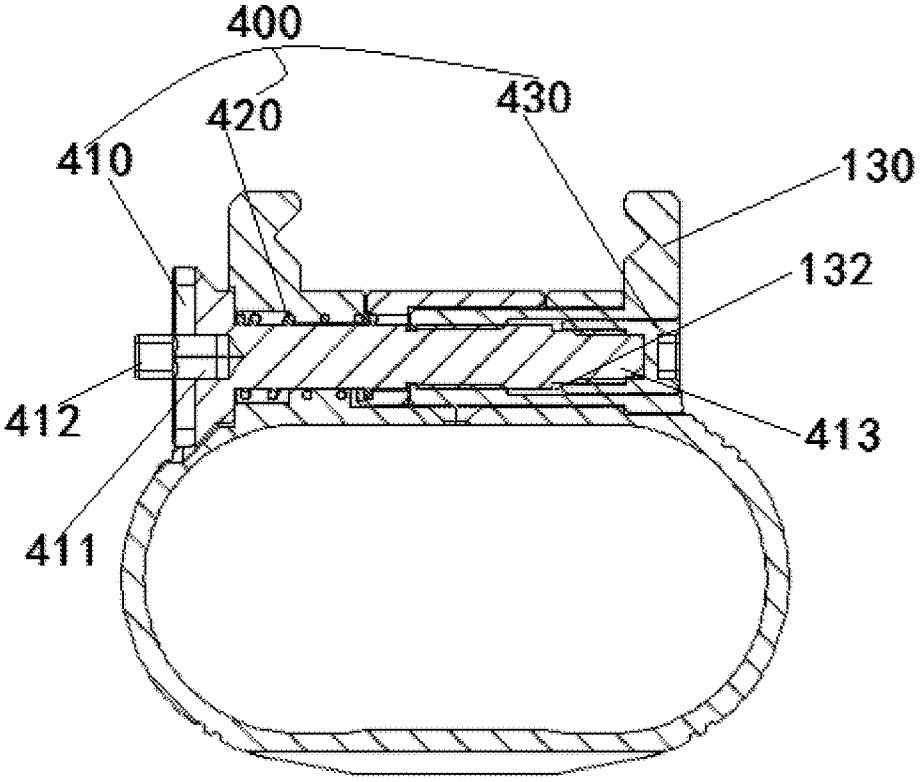
FIG. 5 shows a sectional view of the present utility model along line A-A of FIG. 4.

In one of the embodiments, as illustrated in FIG. 5 and FIG. 7, to realize locking or unlocking of the clamping device 100 for users to adjust the relative position between the sliding block 200 and the clamping device 100, the clamping structure further comprises: a locking device 400, the locking device 400 is configured on the clamping device 100 to lock or unlock the movable block 130; furthermore, the locking device 400 comprises: an adjusting screw 410, a clamping component 420 and a positioning screw nut 430; a tail part of the adjusting screw 410 first passes through the fixed clamping block 120 and the sliding block 200, and then inserts into a connecting hole 132 of the movable clamping block 130; the adjusting screw 410 is rotationally connected to the movable clamping block 130 through screw threaded connection; to ensure that the sliding block 200 is capable to slide inside the sliding groove 141 after being passed through by the adjusting screw 410, an elongated through hole 230 is provided on a side wall of the sliding block 200 along its lengthwise direction, so as to prevent the sliding motions of the sliding block 200 from being blocked by the adjusting screw 410; a length of the elongated through hole 230 equals to a distance between a first positioning area and a last positioning area of any one set of the first positioning areas 1411; the clamping component 420 fixedly sleeves onto the adjusting screw 410 to provide clamping force; an end of the clamping component 420 is fixedly connected to the adjusting screw 410, and another end abuts a side wall of the sliding block 200; in the present embodiment, the clamping component 420 is a spring; the positioning screw nut 430 is inserted into the connecting hole 132 and fixedly connected to a connecting portion 413 of the adjusting screw 410, so as to prevent the adjusting screw 410 from being disengaged from the clamping device 100.

In one of the embodiments, as illustrated in FIG. 2 and FIG. 5, a twisting portion 411 is provided on a head part of the adjusting screw 410 to accommodate a screwdriver; specifically, the twisting portion 411 is provided on a side of the head part of the adjusting screw 410 away from the movable clamping block 130; the twisting portion 411 comprises a plurality of strip grooves or regular polygonal holes; by providing the twisting portion 411, users can loosen or tighten the adjusting screw 410 conveniently with a screwdriver, so as to lock or unlock the movable clamping block 130; furthermore, a pair of convex portions 412 is provided on a head part of the adjusting screw 410; the pair of convex portions 412 is defined by two convex blocks on a head part of the adjusting screw 410 extending away from the movable clamping block 130; by providing the pair of convex portions 412, users can twist the adjusting screw 410 without using a tool, which is convenient for users to install the tactical light.

Figure 8:
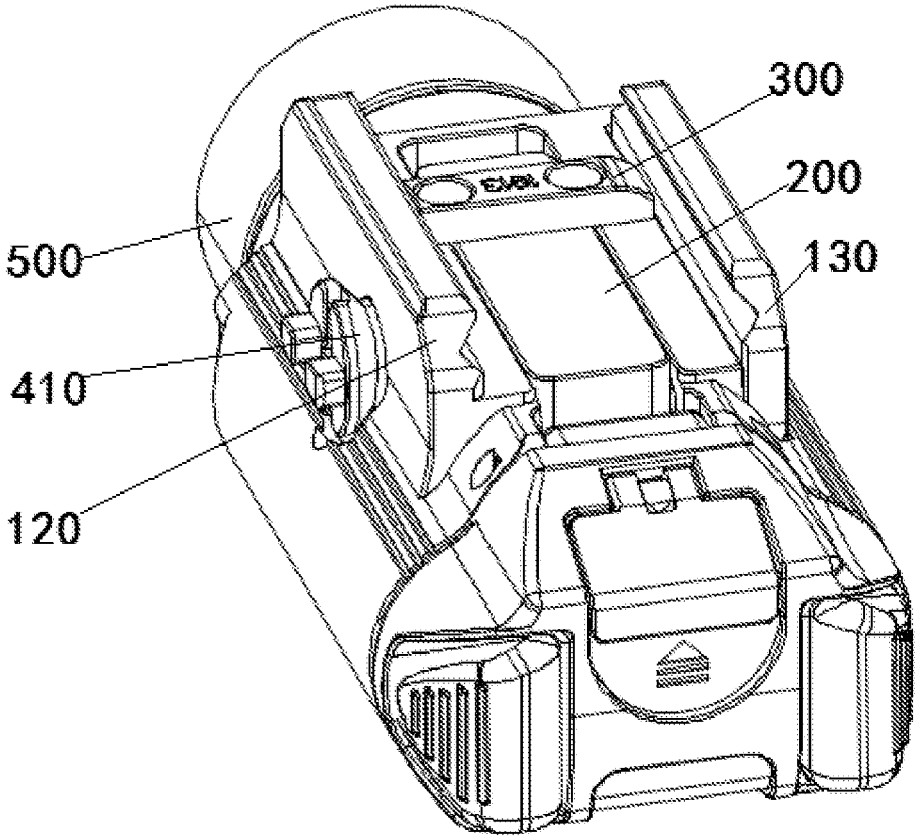
FIG. 8 shows a perspective view of the tactical light of the present utility model.

As illustrated in FIG. 8, the present utility model further provide a tactical light comprising the aforesaid clamping structure, and a light body 500; the clamping structure is fixedly connected to the light body 500; in the present embodiment, the clamping structure and the light body 500 are formed as an integrally structure.

Working principle: When adjusting the tactical light, twist the head part of the adjusting screw 410, and move the movable clamping block 130 towards a direction away from the fixed clamping block 120, until the second positioning portion 131 is completely removed from the second positioning area 220 in which it is initially inserted, slide the sliding block 200 so that the at least one first positioning portion 210 at the bottom part of the sliding block 200 is inserted into another first positioning area 1411; then, twist the head part of the adjusting screw 410 in a reverse direction, and move the movable block 130 in a direction towards the fixed clamping block 120, so that the clamping device 100 clamps tightly to a rail of the firearm wherein the second positioning portion 131 is inserted into another corresponding second positioning area 220 such that the clamping device 100 and the sliding block 200 are stably fixed, thereby completing the adjustment of the position of the tactical light.

It should be understood that, the descriptions above are only the preferable embodiments of the present utility model, which are not intended to set a limit to the protection scope of the present utility model; equivalent changes and modifications made by those skilled in the art without departing from the essence of the present utility model, shall also fall within the protection scope of the present utility model.

What is claimed is:

1. A clamping structure, comprising:

a clamping device; a clamping space is provided on the clamping device; a sliding groove is provided at a bottom part of the clamping space along a lengthwise direction of the clamping space; a plurality of first positioning areas are provided inside the sliding groove along a lengthwise direction of the sliding groove;

a sliding block; the sliding block is slidably provided inside the sliding groove; at least one first positioning portion extends from a bottom side of the sliding block towards the first positioning areas; the at least one first positioning portion is configured to be positioned corresponding to different first positioning areas as the sliding block slides, and the at least one first positioning portion has a shape capable of fitting with the first positioning areas; when the sliding block slides inside the sliding groove, the at least one positioning portion is capable of being fitted with different first positioning areas at different positions to fix the sliding block inside the sliding groove;

an abutting component; the abutting component is fixedly provided on an upper side of the sliding block and located inside the clamping space; when the sliding block slides inside the sliding groove, the abutting component slides along with the sliding block inside the clamping space, so as to adjust a position of the sliding block with respect to the clamping device.

2. The clamping structure of claim 1, wherein the clamping device comprises:

a base; the clamping space is provided on the base;

a fixed clamping block; the fixed clamping block is provided on one side of the base;

a movable clamping block; the movable clamping block is provided on another side of the base; the movable clamping block is movable towards or away from the fixed clamping block under external force; said one side and another side of the base are opposite to each other.

3. The clamping structure of claim 2, wherein a plurality of second positioning areas are provided on a side wall of the sliding block facing the movable clamping block; a second positioning portion is provided on a side wall of the movable clamping block facing the sliding block; the second positioning portion is configured to pass through a side wall of the clamping space and insert into one of the second positioning areas when the movable clamping block moves towards the fixed clamping block; when the movable clamping block moves away from the fixed clamping block allowing the sliding block to slide, the second positioning portion is configured to be positioned corresponding to different second positioning areas as the sliding block slides, and the second positioning portion has a shape capable of fitting with the second positioning areas, when the at least one first positioning portion moves to different first positioning areas at different positions, simultaneously, the second positioning portion corresponds to different second positioning areas at different positions.

4. The clamping structure of claim 3, wherein the clamping structure further comprises: a locking device, the locking device is configured on the clamping device to lock or unlock the movable block.

5. The clamping structure of claim 4, wherein the locking device comprises:

an adjusting screw; a tail part of the adjusting screw first passes through the fixed clamping block and the sliding block, and then inserts into a connecting hole of the movable clamping block;

a clamping component; the clamping component fixedly sleeves onto the adjusting screw to provide clamping force;

a positioning screw nut; the positioning screw nut is inserted into the connecting hole and fixedly connected to a connecting portion of the adjusting screw, so as to prevent the adjusting screw from being disengaged from the clamping device.

6. The clamping structure of claim 5, wherein a twisting portion is provided on a head part of the adjusting screw; the twisting portion is configured to accommodate a screwdriver.

7. The clamping structure of claim 6, wherein a pair of convex portions is also provided on a head part of the adjusting screw.

8. The clamping structure of claim 1, wherein each first positioning portion is an arc-shaped convex element, and each first positioning area is an arc-shaped concave element.

9. The clamping structure of claim 3, wherein the second positioning portion is a positioning column, and each second positioning area is a positioning hole.

10. A tactical light, comprising the clamping structure according to claim 1, and also comprising a light body; the clamping structure is fixedly connected to the light body.

* * * * *